US005313873A

United States Patent [19]

Gall et al.

[11] Patent Number: 5,313,873

[45] Date of Patent: May 24, 1994

[54] DEVICE FOR CONTROLLING THE FLOW OF FLUID TO A FLUID UNIT

[75] Inventors: Heinz Gall, Herrenberg; Kurt Senn, Wernau, both of Fed. Rep. of Germany

[73] Assignee: Mercedes-Benz AG, Fed. Rep. of Germany

[21] Appl. No.: 959,101

[22] Filed: Oct. 9, 1992

[30] Foreign Application Priority Data

Oct. 12, 1991 [DE] Fed. Rep. of Germany ..... 4133892

[51] Int. Cl.[5] ..... F15B 13/044

[52] U.S. Cl. ..... 91/429; 91/441; 91/451; 91/452; 91/454; 91/459; 137/596.17; 137/624.15

[58] Field of Search ..... 91/429, 441, 451, 452, 91/454, 459; 137/596.17, 624.15

[56] References Cited

U.S. PATENT DOCUMENTS

Re. 29,481 11/1977 Larner ..... 137/596.16 X
3,722,543 3/1973 Tennis ..... 137/596.12
4,541,241 9/1985 Schulze ..... 91/441 X
4,870,892 10/1989 Thomsen et al. ..... 91/454 X
5,165,320 11/1992 Ravn ..... 91/454 X

FOREIGN PATENT DOCUMENTS 2752899 6/1978 Fed. Rep. of Germany .
3834918 7/1989 Fed. Rep. of Germany .

OTHER PUBLICATIONS

Steverungen und Regelungen an Pressen-Heute und Morgen, Michael Reinert, pp. 224–226, 228 & 231, O+P vol. 34, No. 4 (1990).

*Primary Examiner*—Gerald A. Michalsky
*Attorney, Agent, or Firm*—Evenson, McKeown, Edwards & Lenahan

[57] ABSTRACT

A fluid unit, for example a piston/cylinder unit, is supplied with fluid via a cyclically opened or closed on/off valve. The vacuum peaks occurring on the outlet side of the on/off valve when it is closed and the inertia forces of the flowing fluid are used to supply additional fluid to the fluid unit via a non-return valve leading from a low-pressure connection or reservoir to the fluid unit.

4 Claims, 3 Drawing Sheets

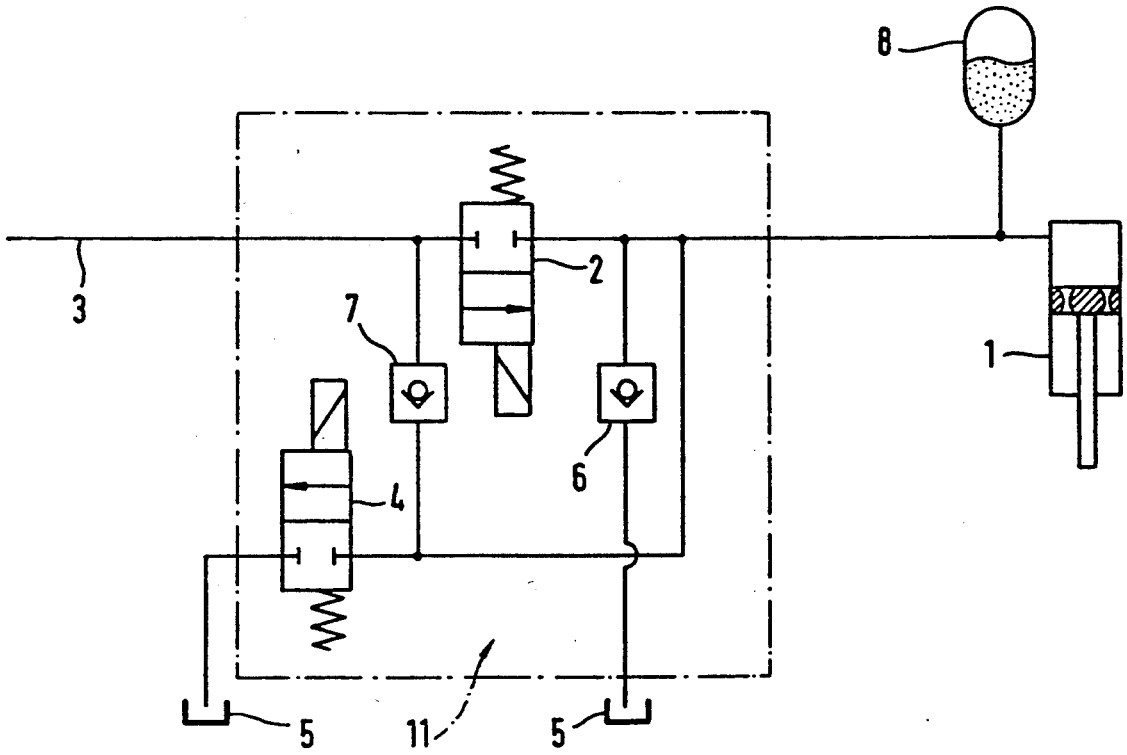
Fig. 2
Fig. 3
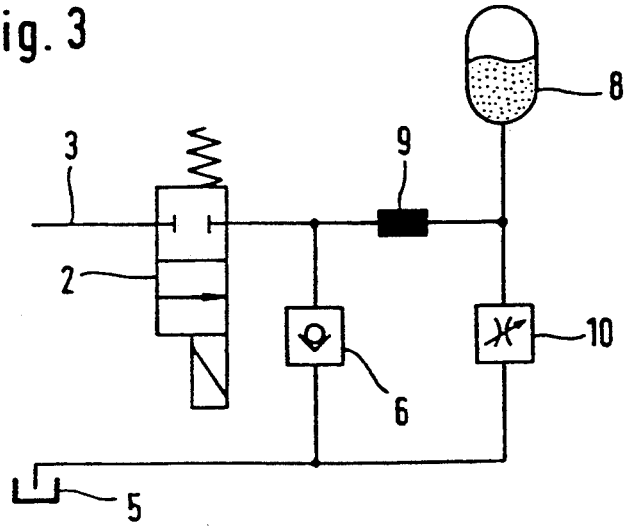

DEVICE FOR CONTROLLING THE FLOW OF FLUID TO A FLUID UNIT

BACKGROUND AND SUMMARY OF THE INVENTION

The present invention relates to a device for controlling the flow of fluid, in particular hydraulic fluid, from a high-pressure source to a fluid unit, such as storage container or consumer unit or actuator, having an on/-off valve substantially without any throttling effect located in a supply conduit, and, more particularly, to a device in which the on/off valve permits a specified or specifiable average supply velocity to be adjusted by cyclic opening and closing with a specified or specifiable ratio between the opening and closing periods.

Fluid flow control devices with on/off valves are basically known and, relative to systems with continuously acting valves, offer the advantage of being more easily achieved in practice. A fundamental disadvantage of such known systems is the relatively high energy requirement. This becomes especially clear when the case of a hydraulic actuator unit (e.g., a piston/cylinder unit), which is connected via the on/off valve to the pressure source in order to carry out an actuation stroke, is considered. In order to carry out an actuation stroke of a specified magnitude, it is necessary to introduce a corresponding quantity V of the hydraulic medium into the hydraulic actuator unit. If the pressure of the pressure source has the value $p_o$, hydraulic energy $E_h = V.p_o$ is consumed during the introduction of the hydraulic medium into the actuator unit. This hydraulic energy $E_h$ is generally larger than the mechanical work $E_m$ performed by the actuator unit because the pressure $p_o$ is generally clearly greater than the minimum pressure necessary for carrying out the actuation stroke of the actuator unit. If, for example, a mass m has to be raised vertically by a distance x by means of the actuator unit, the mechanical work performed by the actuator unit is represented by the product of the weight of the mass m and the distance x. This product is clearly less, to a greater or lesser extent, than the product $V.p_o$ which represents the consumption of hydraulic work $E_h$.

Up to now, no easily practical possibilities for reducing the hydraulic power requirements have been indicated. In German Offenlegungsschrift 27 52 899, a hydraulic consumer unit is connected to a pressure source by way of a cyclically switchable on/off valve and a non-return valve located behind it in series; the non-return valve only permits flow towards the consumer unit. A first throttle is located between the non-return valve and the on/off valve. A further throttle connects the consumer-unit side of the on/off valve, and a pressure storage container located there, to a low-pressure reservoir. Using this known arrangement, the flow of hydraulic medium to the consumer unit can be controlled very sensitively.

Hydraulic medium can only flow to the consumer unit of such known system, however, when the ratio between the opening and closing periods of the on/off valve is sufficiently large, i.e. when the opening periods are relatively long compared with the closing periods. When the ratio mentioned is less than a threshold value, the non-return valve leading to the consumer unit remains closed. High throttling losses do, of course, occur and this is so even if the on/off valve operates substantially without any throttling effect.

A circuit arrangement for controlling a hydraulic drive motor with energy recovery during the braking process is described in German Offenlegungsschrift 38 34 918. Controllable throttle valves are located at the inlet and outlet ends of the hydraulic motor, and are used to control the inlet and outlet of hydraulic medium to and from the hydraulic motor. The circuit arrangement includes on/off valves by virtue of which the inlet end of the inlet-end throttle valve of the hydraulic motor is connected, during its acceleration, to a high-pressure source and is connected, during an operation at constant speed, to a pressure source of lower pressure. In addition, the on/off valves are connected to non-return valves such that regenerative braking of the hydraulic motor is made possible, i.e. the outlet end of the outlet-end throttle valve of the hydraulic motor is connected to a high-pressure storage container during braking so that the hydraulic motor, now operating as a pump, introduces hydraulic medium into this storage container. In this way, the kinetic energy of the hydraulic motor and the units drive-connected to it can be used to charge the high-pressure storage container which can then be used subsequently as the high-pressure source during an acceleration of the hydraulic motor.

Systems for the controlled reduction of pressure in displacer units of presses and the like are known from the publication O+P "Ölhydraulik und Pneumatik" 34 (1990) No. 4, pages 224 to 231; see, in particular, FIG. 4 on page 226. The displacer working space can be connected by several parallel conduits, which have different throttling resistances and are controlled by on/off valves, to a low-pressure reservoir. In order to ensure a pressure which initially falls slowly in the displacer unit, the conduit on/off valve is initially opened with maximum throttling resistance. It is possible to lengthen the opening periods successively. The on/off valve of a conduit with a lower throttling resistance is then additionally actuated later in a manner similar to that previously described.

The question of how the energy necessarily expended during the introduction of the hydraulic medium into the displacer unit can be reduced is not discussed in the above-mentioned publication. The sole provision is for a non-return valve, which only permits a flow towards the displacer unit, located between the low-pressure side and the displacer unit. This non-return valve is obviously intended to be used to ensure complete filling of the displacer unit when the displacer working space expands.

An object of the present invention is to keep the fluidic energy used for the supply of fluid to a fluid unit as small as possible, in particular when the pressure of a fluidic high-pressure source is large compared with the pressure in the fluid unit.

This object has been achieved, according to the present invention, in a flow control device by locating a non-return valve between the fluid unit and a low-pressure connection or reservoir to prevent flow to this low-pressure connection or reservoir so that dynamic vacuum peaks occurring after the closing of the on/off valve at the fluid unit side cause an additional flow of fluid via the non-return valve.

The present invention is based on the recognition that when the on/off valve is closed, dynamic pressure fluctuations with marked vacuum peaks inevitably occur on the side of the on/off valve leading to the fluid unit.

These vacuum peaks can then be used for an additional flow of fluid via the non-return valve. This causes, on one hand, a smoothing of the pressure fluctuations while, on the other hand, no additional external power is consumed for the additional supply of fluid.

The present invention therefore makes it possible to use the kinetic energy generated by the fluid flowing when the on/off valve is open or the associated inertia effects and pressure fluctuations, i.e. in general terms, the inductance of the system, for the supply of fluid to the fluid unit.

The system according to the present invention operates particular effectively if, in accordance with a preferred embodiment, the outlet side of the non-return valve is connected to a conduit part or branch leading to the fluid unit, in which conduit part or branch high flow velocities occur when the on/off valve is open. This is because the high flow velocities cause strong inertia effects when the on/off valve is closed and, correspondingly, a strong flow of fluid via the non-return valve.

If necessary, it is possible to provide for the low-pressure connection or the low-pressure reservoir to have a pressure which is, in fact, reduced relative to the high-pressure source but the reservoir is still not unpressurized. This measure is advantageous for avoiding cavitation.

BRIEF DESCRIPTION OF THE DRAWINGS

These and further objects, features and advantages of the present invention will become more apparent from the following detailed description of currently preferred embodiments when taken in conjunction with the accompanying drawings wherein:

FIG. 2 is a schematic view of the device according to the present invention in association with a hydro-pneumatic supporting unit;

FIG. 3 is a schematic view of the device according to the present invention in association with a pressure reduction arrangement.

DETAILED DESCRIPTION OF THE DRAWINGS

Figure 1:
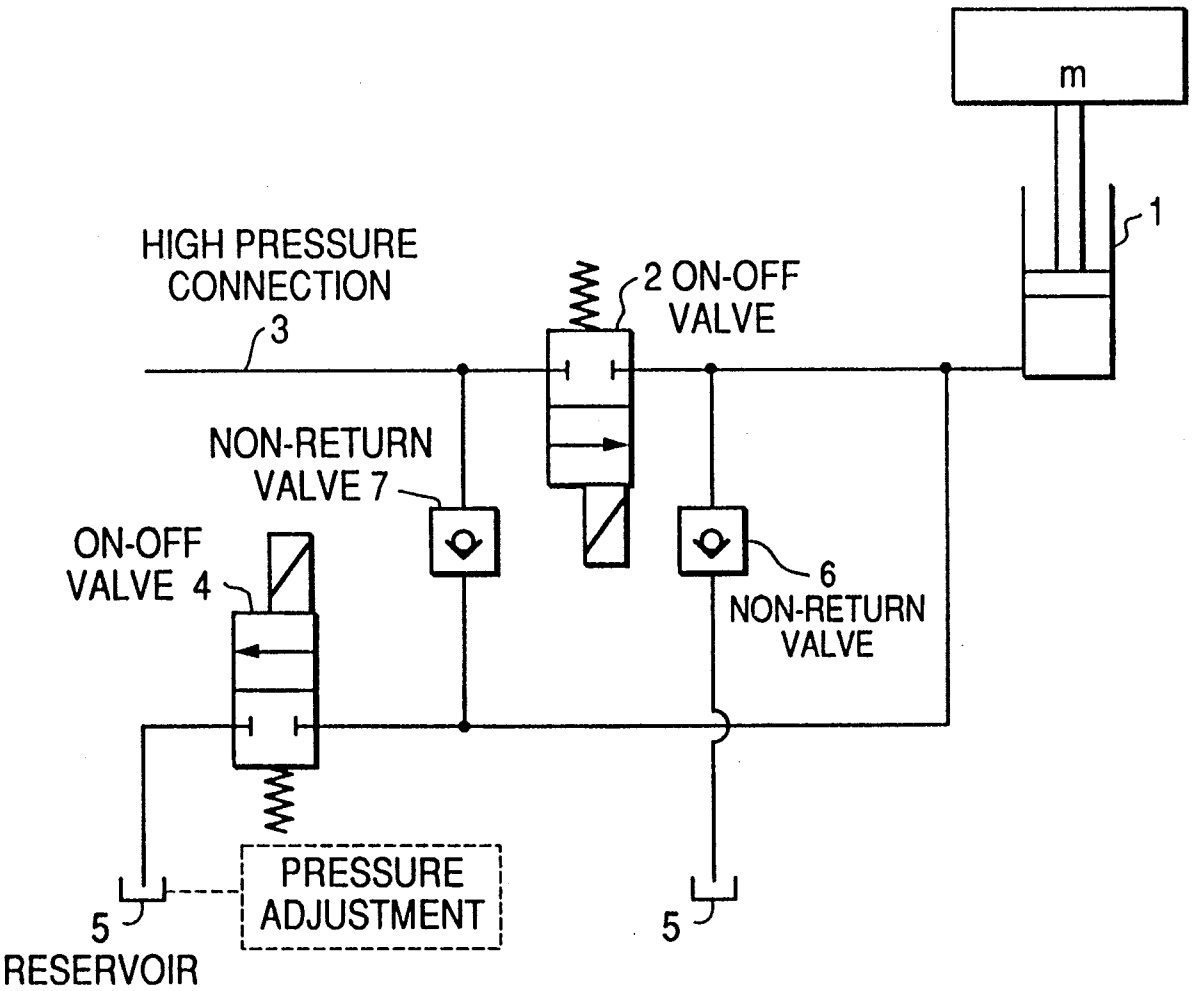
FIG. 1 is a schematic view of an embodiment of the device according to the present invention in association with a hydraulic actuator unit configured as a piston/-cylinder unit.

In FIG. 1, a piston/cylinder unit 1, which is used for displacing a load mass m, can be connected, on one hand, via a first on/off valve 2 to a pressure connection 3 of a conventional high-pressure source (not shown), and, on the other hand, via a second on/off valve 4, to a reservoir 5 which is unpressurized or has a pressure which is lower compared with the pressure connection 3. In addition, the piston/cylinder unit 1 is connected to the reservoir 5 via a first non-return valve 6 which is loaded in the closing direction by the pressure in the piston/cylinder unit 1. Furthermore, a second non-return valve 7, which is subjected to the pressure in the pressure connection 3 in the closing direction, is located between the piston/cylinder unit 1 and the pressure connection 3.

The mode of operation of the foregoing arrangement is first considered during the raising of the load mass m. The second on/off valve 4 remains continuously in the illustrated closed position whereas the first on/off valve 2 is opened for a short period, generally speaking for repeated short periods in a plurality of sequential opening cycles. The hydraulic medium flowing from the pressure connection 3 to the piston/cylinder unit 1 when the on/off valve 2 is open causes an upwards displacement of the piston of the piston/cylinder unit 1 and, therefore, of the load mass m. This upwards motion tends to continue because of mass inertia forces when the first on/off valve 2 is closed. In addition, the mass inertia of the hydraulic medium also becomes effective because the hydraulic medium flowing to the piston/-cylinder unit I when the on/off valve 2 is open tends to continue flowing when the on/off valve 2 is closed.

A corresponding vacuum occurs in the piston/cylinder unit 1 and in the conduits communicating with it after the closing of the first on/off valve 2 and this has the effect, at least for a short period, that the first non-return valve 6 opens and hydraulic fluid flows from the reservoir 5 to the piston/cylinder unit 1. This effect appears particularly strongly when the pressure at the pressure connection 3 is high compared with the pressure in the piston/cylinder unit 1, and correspondingly high flow velocities occur when the on/off valve 2 is opened. When the on/off valve 2 is closed, these high flow velocities lead to marked pressure fluctuations because of the inertia forces of the load mass and of the flowing medium and, therefore, of the impedance of the system.

When the load mass m is being lowered, the first on/off valve 2 remains continuously in the closed position shown whereas the second on/off valve 4 is opened cyclically. When the on/off valve 4 is open, the load mass m and the piston of the piston/cylinder unit 1 descend so that hydraulic medium flows from the piston/cylinder unit 1 into the reservoir 5 via the open on/off valve 4. The downwards motion of the load mass m and the piston of the piston/cylinder unit 1 and also the associated flow of the hydraulic medium tend to continue, because of inertia forces, even when the second on/off valve 4 is switched into its closed position. A pressure peak therefore occurs, at least for a short period, in the piston/cylinder unit 1 and in the conduits communicating therewith. This pressure peak is sufficient to open the second non-return valve 7 for a short period so that hydraulic medium is displaced from the piston/cylinder unit 1 towards the pressure connection 3. As a result, potential energy which has been released by the load mass m is supplied, at least partially, to the pressure supply 3.

The non-return valves 6, 7 therefore have a free-wheel function and permit the pressure or vacuum peaks occurring during closure of the on/off valves 2 and 4 to be used to displace the load mass m in the upwards or downwards direction. The energy appearing as lost power, in this instance the kinetic energy of the load mass m, the piston and the moving hydraulic medium, is correspondingly used for active work.

The embodiment shown in FIG. 2 differs from the embodiment of FIG. 1 essentially in the fact that the piston/cylinder unit together with a spring storage container 8, forms a hydro-pneumatic spring unit. In addition, the piston of the piston/cylinder unit 1 is pierced by axial throttle holes through which hydraulic medium flows during a stroke motion of the piston. The static supporting force generated by the piston/cylinder unit 1 is determined by the pressure in the piston/cylinder unit 1 and the cross-section of the piston rod.

The operation of the embodiment of FIG. 2 is such that, when hydraulic medium is introduced into the piston/cylinder unit 1 and into the associated spring storage container 8, the on/off valve 4 remains continuously in the illustrated closed position whereas the first on/off valve 2 is opened sequentially or cyclically, more or less often, for a short period. The flow occurring in the conduit to the piston/cylinder unit 1 and to the spring storage container 8 when the on/off valve 2 is opened tends to continue when the on/off valve 2 is closed because of inertia forces of the oil in the conduit 9 so that a more or less strong vacuum occurs behind the on/off valve 2 in the flow direction. As a result, the first non-return valve 6 can open and additional hydraulic medium flows from the reservoir 5 into the conduit system, on one hand, between the on/off valve 2, and, on the other hand, the piston/cylinder unit 1 and the spring storage container 8. In this way, therefore, additional hydraulic medium can reach the pressure system on the outlet side of the first on/off valve 2 even after this valve has been closed. The quantity of hydraulic medium flowing through the non-return valve 6 can be made relatively large by appropriate dimensioning of the conduit inductance of the conduit leading to the piston/cylinder unit 1 and to the spring storage container 8 and by matching the cyclic frequency by which the on/off valve 2 is actuated.

If hydraulic medium is to be removed from the pressure system formed by the piston/cylinder unit 1 and the spring storage container 8, the on/off valve 2 remains continuously closed whereas the second on/off valve 4 is opened sequentially, more or less often, for a short period. The flow occurring on opening the on/off valve 4 still tends to continue even after the closing of the on/off valve 4 because of inertia forces which are caused by the conduit inductance 9. This has the result that wave-shaped sequential pressure peaks occur which lead to opening of the second non-return valve 7. Thus, hydraulic medium can be removed from the pressure system on the inlet side of the on/off valve 4 even after the closing of this valve, this pressure medium being supplied to the pressure connection 3 and therefore increasing the energy stored in the pressure source connected thereto.

As is shown in FIG. 3, the invention can also be used, for example in pressure reduction, aside from drive technology. A pressure reduced relative to the pressure level in the pressure connection 3 is to occur at the controllable load throttle 10, the spring storage container 8 for maintaining the desired pressure level being recharged via the on/off valve 2 and the conduit, with the conduit inductance 9, connected thereto. For this purpose, the on/off valve 2 is opened cyclically. Because of inertia forces caused by the conduit inductance 9, the flow to the spring storage container 8 still tends to continue even after the closing of the on/off valve 2 so that a more or less strong vacuum occurs behind the on/off valve which leads to opening of the non-return valve 6 so that hydraulic medium flows from the low-pressure side of the throttle 10 to the spring storage container 8.

In all the above-discussed embodiments, mass inertia forces and pressure fluctuations are therefore used as effects of an inductance of pressure systems in order to avoid energy losses which would otherwise occur.

The on/off valves 2, 4 and the non-return valves 6, 7 can form a noise-insulating or noise absorbing encapsulated circuit block 11 as shown schematically in FIG. 2.

Figure 4:
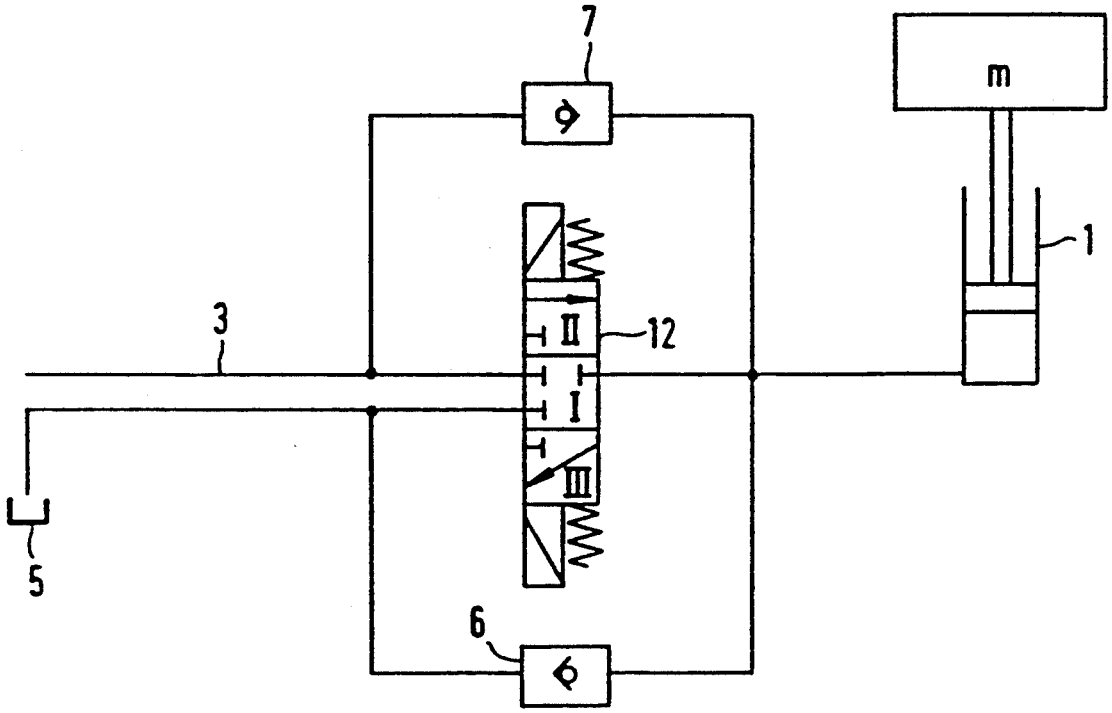
FIG. 4 is a schematic view of another embodiment of the device shown in FIG. 1.

If appropriate, a single 3/3-way valve 12 as shown in FIG. 4 can be provided instead of the two on/off valves 2, 4 in FIG. 1. In order to raise the load mass m, this valve 12 is switched over cyclically from the position I shown to the position II. In order to lower the load mass m, cyclic switching-over takes place into the position III.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A device for controlling the flow of hydraulic fluid from a high-pressure source to a fluid-actuable unit, comprising a supply conduit operatively connected with the high-pressure source, means including an on/-off valve substantially without any throttling effect located in the supply conduit for permitting an average supply velocity to be adjusted by cyclic opening and closing of the on/off valve with a ratio between periods of the cyclic opening and closing to cause a transfer of kinetic energy to the fluid-actuatable unit, and a non-return valve means operatively arranged in an unthrottled manner between the fluid-actuatable unit and one of a low-pressure connection and low-pressure reservoir for preventing a flow to one of the low-pressure connection and low-pressure reservoir and in a location where high flow velocities occur when the on/off valve is open so that dynamic vacuum peaks occurring after the closing of the on/off valve are of sufficient magnitude to open the non-return valve means and to continue the transfer of kinetic energy to the fluid-actuatable unit.

2. The device according to claim 1, wherein a second on/off valve is located between the fluid unit and the one of the low-pressure connection and low-pressure reservoir, and a second non-return valve is located between the fluid unit and one of a pressure connection and the high-pressure source, the second non-return valve only opening in the case of a flow in the direction of one of the pressure connection and the high-pressure source, and that dynamic pressure peaks occurring on the side of the fluid unit when the further on/off valve is closed cause an additional flow of fluid to one of the pressure connection and the high-pressure source via the second non-return valve.

3. The device according to claim 1, wherein the on/-off valve is configured and arranged to be switched from a shut-off position into a second position, on one hand, connecting the pressure connection to the fluid unit, and into a third position, on the other hand, connecting the fluid unit to one of the low-pressure connection and low-pressure reservoir, and a second non-return valve is located between the fluid unit and one of a pressure connection and the high-pressure source, the second non-return valve only opening in the case of a flow in the direction of one of the pressure connection and the high-pressure source, and dynamic pressure peaks occurring on a side of the fluid unit when switching over the on/off valve from the third position connecting the fluid unit to one of the low-pressure connection and low-pressure reservoir into the shut-off position cause an additional flow of fluid via the second non-return valve to one of the pressure connection and the high-pressure source.

4. The device according to claim 1, wherein the one of the low-pressure connection and low-pressure reservoir are configured so that the pressure thereof is adjustably controllable.

* * * * *